US005222621A

United States Patent [19]

Matias

[11] Patent Number: 5,222,621

[45] Date of Patent: Jun. 29, 1993

[54] MODIFIED FLEXIBLE INSERT FOR A GENERALLY RECTANGULAR CONTAINER

[76] Inventor: Carlos J. D. Matias, Praca Pereira Coutinho, No. 175, Apt. 111, Vila N. Conceicao, 04510, Sao Paulo, SP, Brazil

[21] Appl. No.: 911,722

[22] Filed: Jul. 10, 1992

Related U.S. Application Data

[63] Continuation-in-part of Ser. No. 729,735, Jul. 15, 1991, Pat. No. 5,137,170.

[30] Foreign Application Priority Data

Mar. 24, 1992 [BR] Brazil ..... 9201012

[51] Int. Cl.[5] ..... B65D 88/00

[52] U.S. Cl. ..... 220/470; 220/1.5

[58] Field of Search ..... 220/1.5, 9.1, 403, 470

[56] References Cited

U.S. PATENT DOCUMENTS

| | | | |
|---|---|---|---|
| 2,912,137 | 11/1959 | Taylor | 220/470 X |
| 3,402,845 | 9/1968 | Ericksson | 220/1.5 |
| 3,696,952 | 10/1972 | Bodenheimer | 214/314 |
| 3,868,042 | 2/1975 | Bodenheimer | 220/63 R |
| 3,951,284 | 4/1976 | Fell et al. | 214/152 |
| 3,980,196 | 9/1976 | Paulyson et al. | 220/1.5 |
| 4,054,226 | 10/1977 | Bielland et al. | 220/1.5 X |
| 4,232,803 | 11/1980 | Muller et al. | 222/105 |
| 4,601,405 | 7/1986 | Riemer | 220/1.5 |
| 4,792,239 | 12/1988 | Hamada et al. | 383/22 |
| 4,863,339 | 9/1989 | Krein | 414/786 |
| 4,875,596 | 10/1989 | Lohse | 220/403 |
| 4,911,317 | 3/1990 | Schloesser et al. | 220/1.5 |
| 5,040,693 | 8/1991 | Podd, Sr. et al. | 220/470 X |
| 5,059,084 | 10/1991 | Krein | 220/403 X |
| 5,137,170 | 8/1992 | Matias | 220/470 |

FOREIGN PATENT DOCUMENTS 0331491 6/1989 European Pat. Off. .

*Primary Examiner*—Steven M. Pollard

*Attorney, Agent, or Firm*—Schweitzer Cornman & Gross

[57] ABSTRACT

A flexible insert for a container is provided with obliquely extending interior reinforcing straps that connect a door wall portion of the insert to one or more walls of the container to make the door wall portion more resistant to outward bulging when the insert is filled with fluid or particulate cargo. The door wall portion is reinforced by intersecting reinforcing straps to delineate said door wall portion into tiers of sub-portions. Straps extend outward from the insert to suspend a peripheral portion of the insert to aligned cargo rings or cooperating straps carried by one or more walls of the container. Front and rear flaps reversely folded or other reinforcement means to reinforce the floor portion are attached to the floor wall of the container to keep the insert from shifting. Installers need not enter the insert to fix it to the container. Shooters and flaps are included to control loading and unloading. The insert may be compartmentalized.

47 Claims, 9 Drawing Sheets

FIG. 17A.
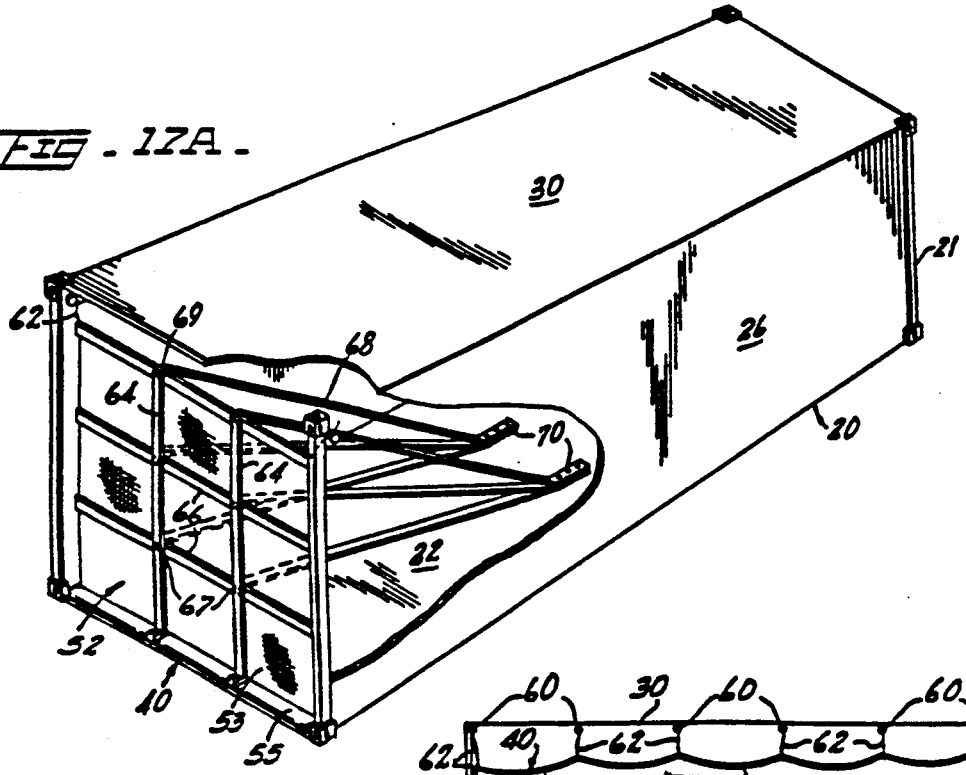
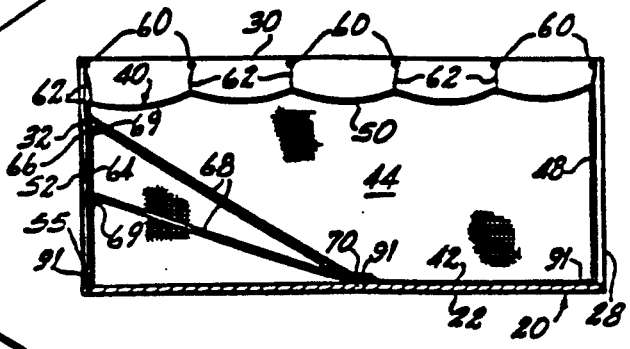
FIG. 17B.
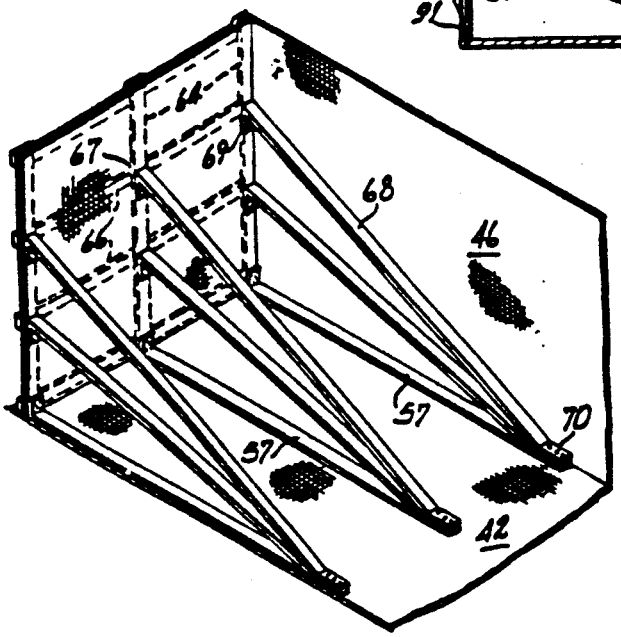
FIG. 18.

MODIFIED FLEXIBLE INSERT FOR A GENERALLY RECTANGULAR CONTAINER

RELATION TO OTHER APPLICATIONS

This application is a continuation-in-part of U. S. patent application Ser. No. 07/729,735 of Carlos J. D. Matias, filed Jul. 15, 1991 for FLEXIBLE INSERT AND METHOD OF INSTALLATION WITHIN A GENERALLY RECTANGULAR CONTAINER, now U.S. Pat. No. 5,137,170.

FIELD OF THE INVENTION

This invention relates to the shipment of bulk materials in shipping vehicles and more particularly to a flexible liner suitable for installation in a standard international container or cargo vessel such as a trailer, truck, rail car or air or seagoing cargo storage space together with a method of installing the flexible insert within a generally rectangular container or cargo storage space. The term "container" will be used hereinafter to cover containers, cargo vessels and cargo storage space. The term "bulk material" includes, but is not limited to substances in the form of powder, pellets, flakes or granules, and also includes liquids. Examples of bulk material include coffee beans, salt, grains and the like.

A large proportion of goods and bulk materials transported today are stored in rigid containers for movement. Many of these containers are of a standard size so that they may be used on both land based vehicles, ships and barges and may also be stacked aboard large seagoing vessels or aircraft. For economic reasons, it has been found desirable to ship bulk materials in containers and in order to do this, a flexible liner has been used in a standard container.

Prior to this invention, flexible containers have been used within standard containers of generally rectangular configuration. However, these containers are susceptible of opening and permitting the load to be lost by spillage when the door to the standard container at one end thereof is opened. There have been cases where laborers working with these containers have been injured during the unloading of the loads stored in these inserts for the standard containers. When cargo is loaded into a flexible insert or when the door of a container provided with a flexible insert is opened for inspecting the cargo, the flexible insert bulges outward, making it difficult and even impossible to reclose the door of the container.

Care must be taken to insure that the insert within the standard container is not applied in such a manner that it is movable within the container, because relative movement between the insert and the container may tear the wall of the flexible insert and cause the contents to spill. Unless steps are taken to secure the insert to the container and to provide means to maintain the rear end wall of the insert in close relation to the corresponding rear end wall of the container, problems arise. Spillage of material from a torn flexible insert may contaminate the container and make its further use impossible without first requiring very careful cleaning and scrubbing of the container to remove all vestiges of the contents of a previous load. Also, the flexible insert must resist tearing in cases where direct contact of the bulk material with the container would cause the container to contaminate the bulk material, or vice versa. Also, the flexible insert must be composed of a material that is impervious to the cargo with which the insert is loaded.

Many attempts have been made in the prior art to develop a technique of using flexible inserts for standard size containers as will be discussed in a review of patents that came to the attention of applicant's associates in the course of a novelty search and patent office prosecution.

U.S. Pat. No. 2,912,137 to Taylor, issued Nov. 10, 1959, discloses a reusable insert or liner for a container having a floor and four upstanding side walls forming a unitary structure and having a plurality of L-shaped flexible reinforcing elements spaced around the periphery of the structure.

U.S. Pat. No. 3,402,845 to Eriksson, issued Sep. 24, 1968, discloses collapsible containers of skeleton construction that contain diagonal stays near certain corners of the container. Each stay contains a turnbuckle to facilitate its dismantling or assembly as a rigid connection between adjacent horizontal frame members so that when the stays are rigid, the container opens to receive a load and when the stays are dismantled, the containers collapse for stacking.

U.S. Pat. No. 3,696,952, issued Oct. 10, 1972, and U.S. Pat. No. 3,868,042, issued Feb. 25, 1975, to Bodenheimer, disclose a flexible bag member adhered at spots to an empty container wall which has bulkheads wedged between the container sidewalls that move with the insertion of a load of bulk material. The bulkhead is provided with suitable openings that are normally sealed during transport to facilitate loading and unloading of the liner within the container.

U.S. Pat. No. 3,951,284 to Fell, et al, issued Apr. 20, 1976, uses a stretchable connector means to support a flexible liner within the adjacent walls of a standard container.

U.S. Pat. No. 3,980,196 to Paulyson et al., issued Sep. 14, 1976, discloses a pair of flexible, load distributing, front cross members, a rear frame, and a rear bulkhead mounted on the rear frame to mount and securely retain a flexible bag as a liner within a freight container and support the bag against damage or rupture.

U.S. Pat. No. 4,054,226 to Bjelland, et al, issued Oct. 18, 1977, shows a flexible insert for use within a container. The flexible insert has structural front and rear frames, the front frame retaining the front end of a liner bag in generally rectangular configuration to transmit stresses on the bag to structural members of the container and a laterally curved rear bulkhead supporting the rear end of the bag relative to the standard container to prevent its rupture or collapse during loading or unloading of the flexible insert.

U.S. Pat. No. 4,232,803 to Muller, et al, issued Nov. 11, 1980, shows a system that utilizes a pair of retainers to support a flexible liner within a container. This system requires a two door opening.

U.S. Pat. No. 4,601,405 to Riemer, issued Jul. 22, 1986, discloses a device for closing an open end of a cargo holding sleeve used within a standard container. The device consists of three triangular sheets which are respectively connected at a base edge to separate side walls of the sleeve and the apex portions of the sheets are connected together to cooperate to close the end of the sleeve.

U.S. Pat. No. 4,792,239 to Hamada, et al, issued Dec. 20, 1988, discloses an adjustable belt for hanging a flexible inner bag to the inner wall of a container.

U.S. Pat. No. 4,863,339 to Krein, issued Sep. 5, 1989, discloses applying a vacuum between the outer wall of a flexible bag and the inner wall of a container within which the flexible bag is stored for shipment in order to facilitate removing the air between the flexible bag and the container.

European Patent publication 331,491 to Dorse, published Sep. 6, 1989, discloses a flexible insert bag reinforced by a harness for a snug fit within a container.

U.S. Pat. No. 4,875,596 to Lohse, issued Oct. 24, 1989, discloses a tubular flexible vessel supported within a container spaced from the container walls with its ends closed by a clamp connection.

U.S. Pat. No. 4,911,317 to Schloesser et al., issued Mar. 27, 1990, discloses a bag made of a flexible gas and water impermeable material placed within a 150 type shipping container. The bag has an entry flap positioned adjacent to the door of the container with an air and water resistant zipper sealing the flap with the bag, and having a resealable port for inflating and evacuating the bag to control its interior environment.

U.S. Pat. No. 5,040,693 to Podd et al., issued Aug. 20, 1991, discloses a liner for a cargo container that comprises an inflatable body and side connecting straps that are connected to the sides of the inner body and are releasably clamped to the side edge portions of the container floor, using elongated wooden slats over the connecting strips that are nailed to the container floor through the connecting strips.

U.S. Pat. No. 5,059,084 to Krein, issued Oct. 22, 1991, discloses a flexible liner inserted within a polygonal container to form an interior cavity between the outer surface of the liner and the inner surface of the container. A vacuum applied to the interior cavity shapes the liner to conform to the shape of the container.

A more recent novelty search reported the following publications as relevant to the presently claimed invention:

| | | |
|---|---|---|
| France - 2,461,661 | Kleber-Colombes | June 2, 1981 |
| European - 0,274,417 | Kaisha | July 13, 1988 |
| European - 0,280,493 | Kaisha | Aug. 31, 1988 |
| European - 0,280,495 | Kaisha | Aug. 31, 1988 |
| International - WO 88/09755 | Chick | Dec. 15, 1988 |
| United Kingdom - GB 2,226,300 | Kaisha | June 27, 1990 |
| United States - 4,966,310 | Hawkins | Oct. 30, 1990 |

None of the aforesaid publications incorporate internal obliquely extending reinforcing straps that are constructed and arranged for connection at one end to a rear door portion of an insert at their rear ends and to another portion of the insert to reinforce the rear door portion against outward bulging when the rear door of a container loaded with cargo within said flexible insert is opened.

BRIEF DESCRIPTION OF THIS INVENTION

This invention relates to a flexible insert, of plastic or other flexible material, impervious to the cargo carried, such as canvas or woven jute, that is unfoldable into a shape that approximates the shape of a cargo vehicle or a standard container within which it is applied. The standard container may be suitable for use in an ocean freighter, a trailer for road transportation or a rail car. The invention provides for the safe transport of most bulk materials through a lashing and loading system that suspends the flexible insert from the upper part of a container having several walls including an optional roof wall, a floor wall, left and right side walls, a closed front wall, and a rear end wall comprising one or more doors. The flexible insert of this invention is characterized by a flexible end door portion that is reinforced by obliquely extending strap means that connects the end door portion to at least one of the walls of the container and unfolds to be taut to prevent outward bulging of the end door portion when the container is loaded with cargo and the rear end wall is opened.

The flexible plastic insert of one embodiment of this invention has flexible insert portions corresponding to walls of said container. The insert has suspension means elements, such as a series of flexible straps that cooperate with cooperating suspension means elements carried by said containers, such as a plurality of spaced cargo rings or additional attachment straps, attached to various walls of the standard container for suspending the flexible insert from the container in such a manner that its bottom portion rests in smooth condition on the floor wall of the container while the other insert portions are adjacent other corresponding walls of the container. The mass of the material that is inserted into the flexible insert does not bear on the insert but on the container because the insert rests with its floor wall portion on the floor wall of the container.

Optional insert reinforcement means is provided to reinforce the floor wall portion and/or side wall portion of the insert so that the insert is constructed and arranged to be attached by attachment means, such as nails or screws or the like, through the optional reinforcing means to the floor wall and/or corresponding side walls of the container to prevent relative sliding of the insert with respect to the container. Preferably, front and rear flap portions are provided to reinforce the floor portion of the insert to receive the attachment means that attach the insert to the floor wall of a container. Also, the attachment of cooperating suspension means members, such as straps extending from the outer surface of the insert to corresponding cargo rings or corresponding straps of the container, merely suspends the insert within the volume defined by the container so that the floor portion of the insert rests smoothly on the floor of the container. The optional insert reinforcement means, particularly the rear flap portion, may be omitted if the insert is sufficiently strong to be attached to the container without needing said reinforcement means, or when the floor portion is reinforced with additional floor portion reinforcing means.

The rear portion of one species of the insert comprises an end door portion extending upward from the rear end of the floor portion to reach the upper rear ends of the walls of the container, or, if the end door portion does not extend upward to reach the upper ends and the optional roof wall is present, an optional upper end flap portion extending rearwardly of the rear of a corresponding optional roof portion of the insert may be provided to overlap the end door portion of the insert. The end door portion may be integral with the insert or constructed and arranged to be fixed to the rear end of the floor portion of the insert when the latter is installed within the container.

A plurality of crisscrossing reinforcing straps, preferably comprising vertically spaced, horizontally extending reinforcing straps and a plurality of horizontally spaced, vertically extending reinforcing straps or crisscrossing reinforcing straps arranged angularly other than orthogonal may be provided on the end door portion of the flexible insert and a plurality of internal obliquely extending reinforcing straps are also included to connect the end door portion to one or more walls of the container, preferably the floor wall. These latter straps extend to be taut when the insert is loaded to resist outward bulging of the end door portion. Metal chains or linkages that collapse when folded and extend to be taut when stretched are included in the term "oblique reinforcing straps" within the parameters of this invention.

The upper end flap portion may be omitted entirely if the rear end portion is higher than the load level for the insert. In the latter case, the end door portion of the insert need not extend the entire upward distance to the optional roof wall of the container. However, the upper end portion of the end door portion may have additional straps to secure the end door portion to the upper end of the container such as its optional roof wall or the upper ends of its side walls or end door wall by tying the additional straps to additional cargo rings or suspension straps supported across the width of the upper end of the container near the exit door. When the end door portion is sufficiently high to extend upwardly to reach the optional container roof wall, the upper end of the end door portion is constructed and arranged as an auxiliary flap portion to replace the unneeded upper end flap portion of the optional roof portion and is able to fold upwardly to be sewn to an optional roof portion, and to fold downwardly (either inwardly or outwardly) to provide an air escape passage below the upper end of the container roof wall while the exit door portion below the fold is supported by the oblique reinforcing straps to avoid outward bulging in the reinforced portion of the exit door portion.

Each interior oblique reinforcing strap for the end door portion has a front end connected to one or more walls of said container preferably at its floor wall or cargo rings fixed to said walls and a rear end secured to the end door portion preferably to at least one of the reinforcing straps in the end door portion. When the container containing the insert is loaded with cargo, the obliquely extending reinforcing straps become taut to support the end door portion in a substantially vertical position to prevent the end door portion of the insert from bulging outward beyond the door of the container. This structure keeps the granular material or liquid that is stored within the insert from bulging out beyond the confines of the container. In addition, various flaps are provided to control which selected portion of the stored material is to be unloaded from the insert within the container. The crisscrossing and preferably horizontally extending and vertically extending reinforcing straps intersect one another throughout the end door portion to provide means for reinforcing the end door portion of the insert and also provides most preferred means for securement to the rear ends of the oblique reinforcement straps that interconnect the end door portion of the insert to other wall portions of the insert and, hence, to corresponding walls of the container, so that the oblique reinforcing straps, when tightly stretched, support the end door portion vertically. The flexible insert is preferably so constructed and arranged that it can be attached directly to a container without requiring an installer to enter the insert during said attachment. The flexible insert must include an end door portion subject to outward bulging that the oblique reinforcing straps constrain regardless of the presence or absence of other wall portions in the flexible insert.

In an illustrative embodiment, upper strap means extend upwardly from the front end portion, the end door portion and the side portions of the insert to cooperate with a plurality of cargo rings or attachment straps spaced along the length of the container side walls and end walls when no roof wall is present or along the length of the upper front, rear, left and right corner portions formed between the end walls and left and right side walls on one hand and the optional roof wall of the container, so that the flexible insert may be installed in a folded condition within the container with its optional front flap portion or the front of the floor portion resting on the front of the floor wall of the container and the forward part of the floor portion of the insert extending rearward from its optional front flap portion to an intermediate area containing lower forward ends of the oblique reinforcing straps of the preferred embodiment resting flat on the corresponding part of the container floor. After securing the optional front flap portion or the front end of the floor portion and the lower forward ends of the oblique reinforcing straps to corresponding portions of the container floor wall to retain the front floor portion of the insert flat against the front part of the container floor wall, the outwardly extending straps forming insert suspension members of said insert are connected to corresponding cooperating suspension members, such as the cargo rings or attachment straps fixed to said container, to form corresponding cooperating insert suspension members from front to rear with additional floor portion reinforcements, if any, attached from front to rear of the container floor wall securing suspension straps from the insert to cargo rings or other strap attachments of the container and working back, securing any reinforcing flap portions of the insert and the lower ends of the oblique reinforcing straps to the floor wall of the container.

The end door portion of the insert is subdivided into a number of end door sub-portions by the crisscrossing of the end door portion reinforcing straps, which are preferably intersecting vertically extending reinforcing straps and horizontally extending reinforcing straps. Each of the end door sub-portions may have readily openable flaps to provide access for selectively unloading a part of the load supported within the insert within the container as desired at a controlled rate of outflow. This manner of locally opening different parts of the end door portion avoids the sudden rush of stored material that can be harmful to personnel working on the unloading job. Also, while the end door portion is preferably an integral part of the insert, it is also within the scope of this invention to have an insert comprising a separate end door portion whose bottom end is separately fixed to the rear end of the floor portion to complete the insert during its installation within a container.

Another form of flexible insert consists essentially of a flexible end door portion having upper suspension elements such as flexible straps constructed and arranged for suspension from cooperating suspension elements such as cargo rings or attachment straps, fixed to the upper part of a container, a transverse reinforcement constructed and arranged to receive nails or screws or other attachment means that secure the bottom of the flexible end door portion to the rear end of the floor wall of the container and obliquely extending reinforcing straps interconnecting the flexible rear door portion to an intermediate part of the floor wall of the container so that when the container is filled with cargo and the flexible end door portion of the insert is lifted, the obliquely extending reinforcing straps become taut to counteract a tendency for the flexible end door portion of the insert to bulge outward. This embodiment of this invention does not require that the insert include a front end portion or side portions or a floor portion or an optional roof portion to be able to resist outward bulging. However, this embodiment is limited for use with materials that do not harm the walls of the container and that can be readily removed from the container before being loaded with another cargo.

The previous embodiment can be modified to incorporate a floor portion resting smoothly on the floor wall of the container. Other optional modifications for the insert include a front end portion, side wall portions, a roof portion and intermediate wall portions that divide the insert into compartments or an intermediate unreinforced flexible insert may be inserted within the container provided with a flexible end door portion or a reinforced insert containing obliquely extending reinforcing straps.

In another modification, the optional roof portion of the insert may be provided with one or more openings that are alignable with corresponding closeable openings in the roof of the container to facilitate loading of the insert from storage means located above the container.

In still other modifications, the flexible insert may be subdivided into insert compartments by one or more flexible longitudinal walls or flexible transverse walls that permit the separate loading and unloading of separate cargos from separate insert compartments.

These and other benefits of this invention will become obvious after a description of a preferred embodiment and certain modifications thereof is studied.

DESCRIPTION OF THE DRAWINGS

In the drawings that form part of a description of various embodiments of this invention.

FIG. 17A is a fragmentary isometric view of a container having an insert consisting essentially of a flexible end door portion and obliquely extending strap means cooperating with said end door portion to fix the end door portion to the container and avoid outward bulging.

FIG. 17B is a longitudinal section aligned on a strap 68 of an alternate embodiment of a flexible insert in which the insert comprises a separate end door portion of FIG. 17A interposed between an unreinforced flexible insert and the container.

FIG. 18 is a partial isometric view of an insert wherein its floor portion is reinforced with additional reinforcement straps which may augment or replace one or both of the optional flap portions that reinforce the ends of the floor portion.

DESCRIPTION OF PREFERRED EMBODIMENTS

Figure 21:
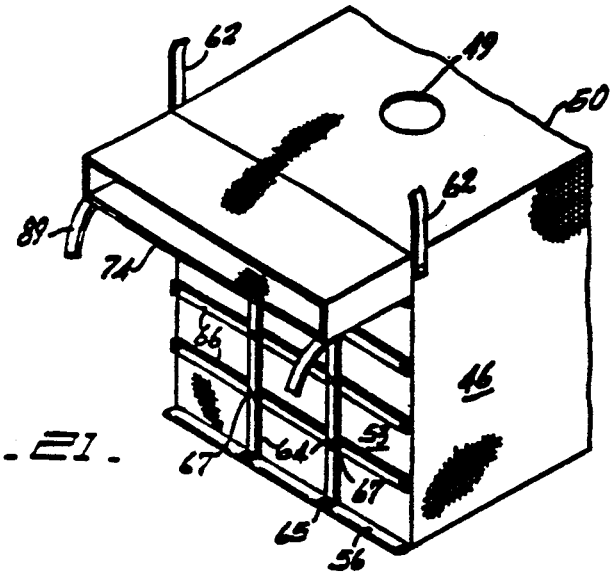
FIG. 21 is an isometric view similar to FIG. 12C showing how an insert may be provided with an aperture in its roof portion.

Referring to the drawings (FIGS. 3, 4, 5 and 7D), a container 20 comprises a metal frame 21 reinforcing a floor wall 22 (composed of metal, wood or the like) from which extend upwardly a right side wall 24 (FIG. 5), a left side wall 26 and a closed front end wall 28. An optional roof wall 30 that may be solid or provided with apertures (FIG. 21) that are preferably closeable, interconnects the upper ends of right side wall 24 and left side wall 26 and also extends from the closed front end wall 28 to a closeable door wall 32. The container is of rectangular cross-section in both elevation and plan and may be associated with a truck, a freighter, a railroad car or aircraft. The walls, roof and floor of container 20 are essentially planar, however the term "planar" as herein defined includes standard container walls that may be of either flat or corrugated shape.

A flexible insert 40 of plastic material of this invention (FIGS. 1 and 2) comprises a floor portion 42 that rests smoothly on the floor wall 22 of the container when installed, a left side wall portion 44 that extends adjacent left side wall 24 of the container, a right side wall portion 46 that extends adjacent the right side wall 26 of container 20, a closed front end portion 48 that extends upwardly adjacent closed front end wall 28 of container 20, and an optional roof portion 50 that extends substantially coextensively below optional roof wall 30 of container 20. Roof portion 50 may extend at its rear end into an optional upper end flap portion 51. An end door portion 52 extends upward from the floor portion 22 of insert 40 inside door wall 32 of container 20 to terminate at or below the rear end of the upper edges of side walls 24 and 26 when installed.

End door portion 52 is sub-divided into end door sub-portions 53 in a manner to be described later. The optional upper end flap portion 51, which extends outwardly beyond roof portion 50 when included, forms a flap that is selectively closed or open, the open position being depicted in FIGS. 1 and 2. Upper end flap portion 51 may be omitted, particularly when a cargo supplied to container 20 does not fill the container completely, thereby leaving an opening above end door portion 52 to exhaust air from the interior of insert 40 when cargo is inserted. End door portion 52 is constructed and arranged to extend upward from floor portion 42 sufficient distance to enclose a cargo that is a partial load or a full load for insert 40. Under these circumstances, upper end flap portion 51 is superfluous and added suspension straps 62 are provided to support the upper end portion of end door portion 52 from additional cargo rings 60 or additional suspension straps 62 fixed to container 20. End door portion 52 is preferably a unitary part of insert 40, but may be provided with a transverse flap 55 (FIG. 17A) through which end door portion 52 is attached to the rear end of floor portion 42 or directly to floor wall 22.

Figure 11:
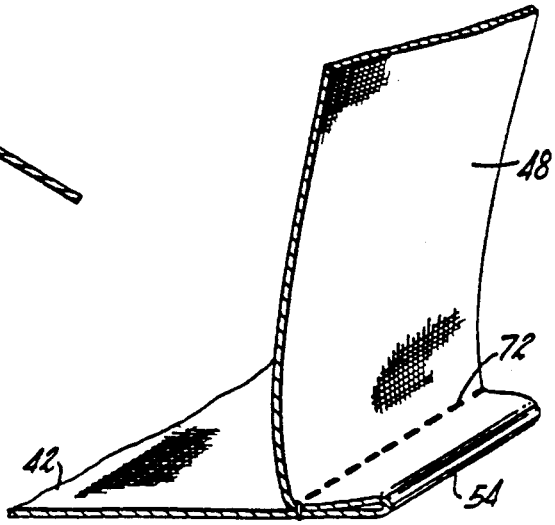
FIG. 11 is an isometric enlarged view of a portion of the closed end wall portion of the flexible insert near the end of its floor portion to show how a folded optional front flap portion interconnects the floor portion of the insert to its front wall portion.

Floor portion 42 is reversely folded and sewn at 72 (FIG. 11) at its forward end to form an optional front flap portion or transverse reinforcement 54 that connects the front end of floor portion 42 and the lower end of closed front wall portion 48. An optional rear flap portion or transverse rear reinforcement 56 is similarly reversely folded and sewn to form an extension of the rear end of floor portion 42 that is curved upward into the lower part of end door portion 52. The number of reversing folds for front flap portion 54 and rear flap portion 56 need not be limited to the two shown in the figures as long as the flap portions are strong enough to receive securing means, such as nails, screws and the like, that secure the flexible insert 40 to the floor wall 22 of container 20 and maintain floor portion 22 smooth, as will be described later. Alternatively or additionally, to fix insert 40 to container 20, left and/or right side portions 44 and 46 may be fixed to corresponding left and/or right side walls 24 and 26, respectively. Longitudinally extending reinforcing straps 57 (FIG. 18) may be attached to extend lengthwise of floor portion 42 to reinforce the latter for further attachment to floor wall 22 and may even make it unnecessary for front flap reinforcement 54 and/or rear flap reinforcement 56 to be included.

Figure 8:
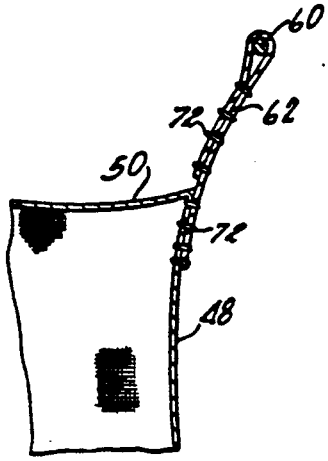
FIG. 8 is an enlarged sectional view of the upper right hand corner of the view of FIG. 7B illustrating one type of top strap for securing the upper right corner of the optional roof portion of the insert to the upper right portion of the optional roof wall of the container within which the insert is installed.
Figure 7B:
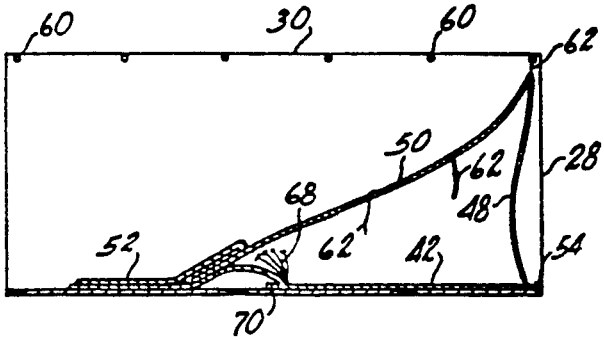
Figure 7C:
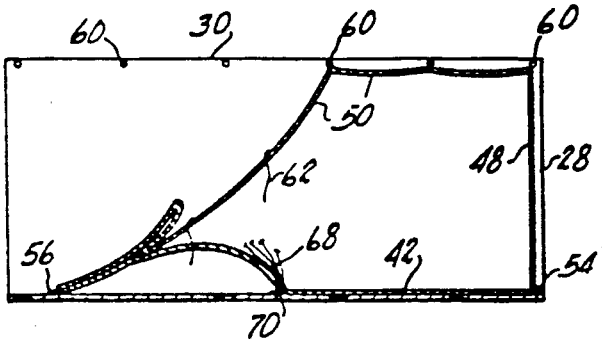

At the upper portion of the container 20 along the upper edges of each of the side walls 24 and 26 and optionally, front end wall 28 and door wall 32, a plurality of insert suspension members, such as longitudinally spaced cargo rings 60 and/or attachment straps (not shown) are arranged from innermost (forward) to outermost (rearward) rings. A cooperating insert suspension member, such as a flexible top strap 62 that may be constructed of reinforced fabric, such as used in automobile seat belts, is provided on insert 40 for as many of cargo rings 60 as needed. Preferably, a unique strap 62 is provided for each cargo ring 60. A typical arrangement is shown in FIGS. 7A through 7D. FIG. 8 shows how a typical top strap 62 is sewn at 72 into an upper portion of closed wall portion 48 and looped through a top cargo ring 60. Additional top straps 62 arranged from innermost to outermost straps to correspond to the positions of cargo rings 60, are connected to extend upwardly from side portions 44 and 46 and are threaded through top cargo rings 60, then sewn together at 72 to form loops extending through corresponding cargo rings 60 so that the flexible insert 40 is suspended from the upper end of container 20 with floor portion 42 resting smoothly on floor wall 22 of container 20.

Figure 9:
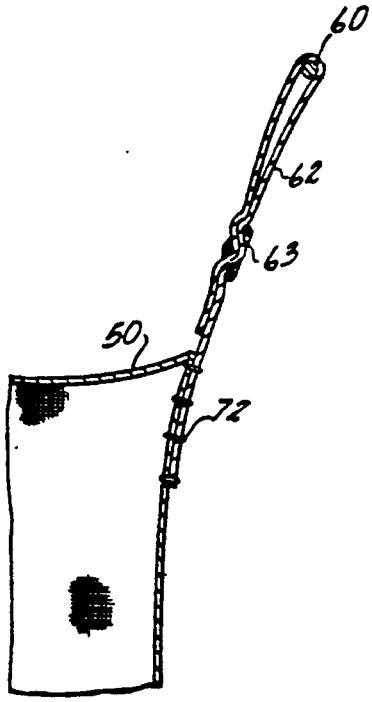
FIG. 9 is a view similar to FIG. 8 of an alternate embodiment of a top strap that incorporates a buckle.
Figure 7D:
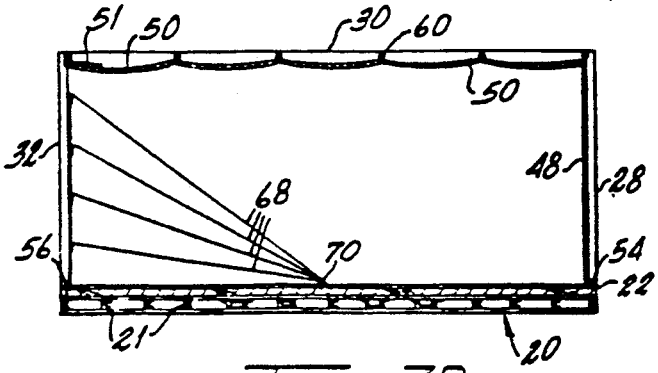

FIG. 9 shows an alternative embodiment of top strap 62 in which the strap is adjustable in length through the use of a buckle 63 through which strap 62 is threaded.

Figure 1:
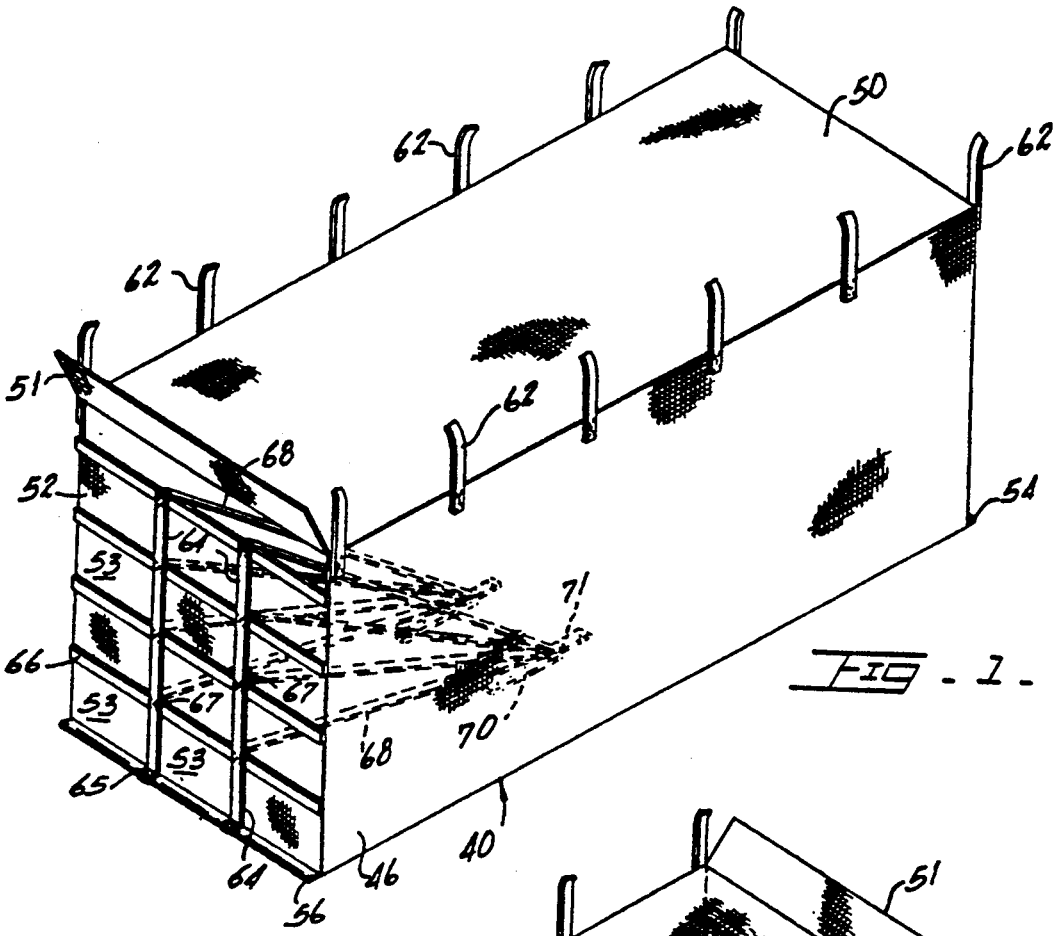
FIG. 1 is an isometric view of a flexible liner showing its shape when inserted within a rigid container and looking from the rear of the door portion of the flexible insert.

End door portion 52 is sub-divided into a plurality of end door sub-portions 53 arranged in checkerboard arrangement shown in FIG. 1. Sub-portions 53 are defined by a plurality of crisscrossing reinforcing straps, preferably horizontally spaced vertical reinforcing straps 64 having lower ends 65 fixed to optional rear flap portion 56 or the rear end of floor portion 42 by sewing and vertically spaced horizontal reinforcing straps 66 that form intersections 67. Thus, sub-portions 53 are arranged in horizontally extending tiers. Criss-crossing reinforcing straps may extend in directions other than horizontal and vertical without departing from the gist of this invention.

Figure 6:
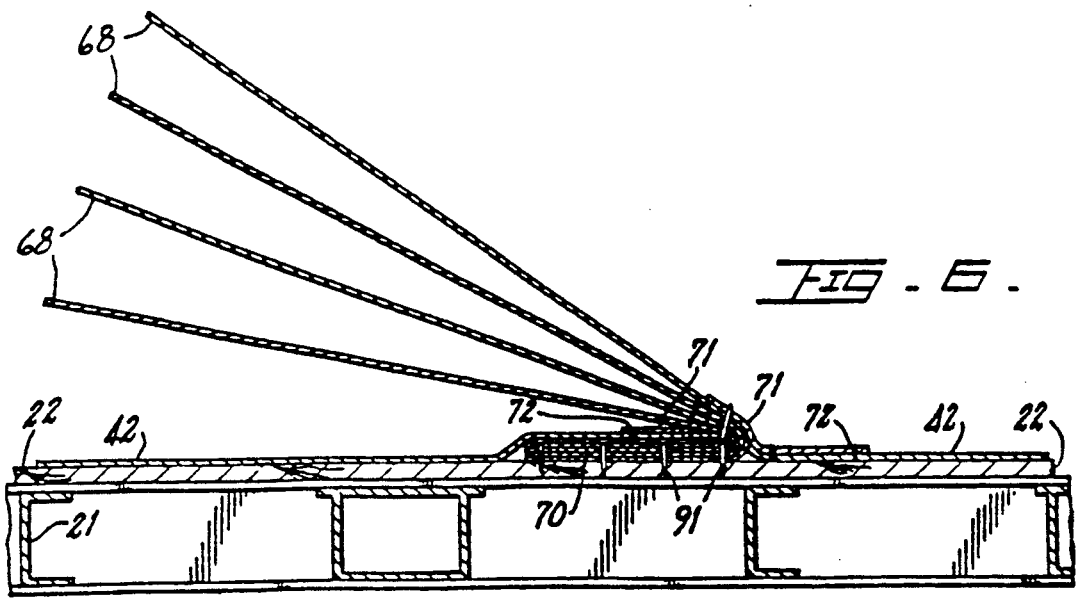
FIG. 6 is an enlarged view of a portion of FIG. 3 showing in detail how one of the arrangements for attaching the lower end of one set of interior oblique straps to the floor portion reinforcement of the insert is arranged.
Figure 7A:
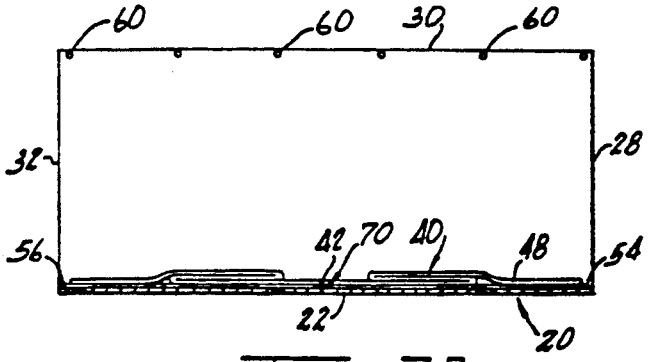
FIGS. 7A, 7B, 7C and 7D are a series of schematic elevational views showing different steps during a preferred method of installing a flexible liner of this invention within a cargo container.

Flexible insert 40 is provided with a plurality of oblique reinforcing straps 68, each having a downwardly folded upper rear end 69 and a rearwardly or forwardly folded forward lower end 70. The upper rear end 69 of each oblique strap 68 is folded downward and attached to end door portion 52, preferably to a vertically extending reinforcing strap 64 and a horizontally extending reinforcing strap 66 at a unique intersection 67 for each oblique strap 68. The lower end 70 of each obliquely extending reinforcing strap 68 extends through a slot of a series of spaced slots in floor portion 42 and is shown folded to the rear for attachment to floor wall 22. Flap means 71 is provided to close any slot receiving the folded lower end 70 of each oblique strap 68 and to reinforce floor portion 42 further in the vicinity of each strap receiving slot. Flap means 71 are sewn to floor portion 42 at 72 in FIG. 6. FIG. 6 also shows in detail how a typical attachment of oblique reinforcing straps 68 is made through their lower ends 70 and nailed at 91 to container floor wall 22. The areas of attachment of lower ends 70 to container floor wall 22 may form an arrangement having a regular pattern or may form a random arrangement.

Figure 10A:
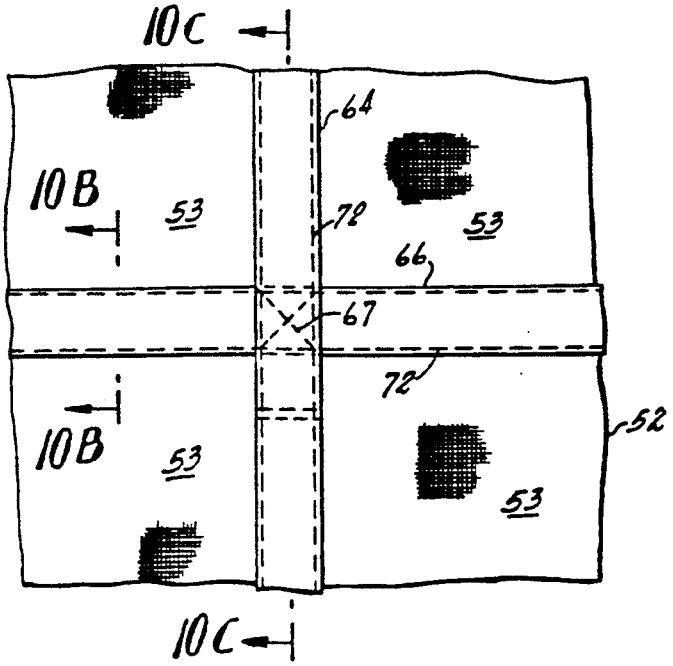
FIG. 10A is a fragmentary elevational view of a localized portion of an end door portion of the flexible insert.
Figure 10B:
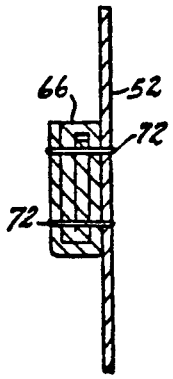
FIG. 10B is a view taken along the lines 10B—10B of FIG. 10A.
Figure 10C:
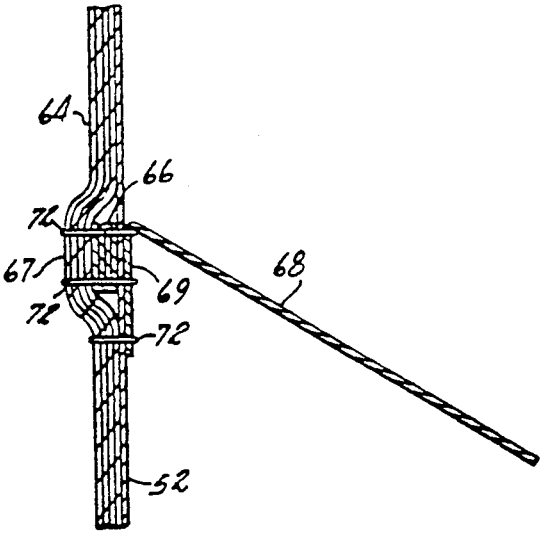
FIG. 10C is a cross-section taken along the line 10C—10C of FIG. 10A.

FIGS. 10A, 10B and 10C show how the upper rear ends 69 of oblique reinforcing straps 68 are attached to the end door portion 52 of flexible insert 40, preferably at the intersections 67 of vertically extending reinforcing straps 64 and horizontally extending reinforcing straps 66. Note that reinforcing straps 64 and 66 are reversely folded for improved strength and are interconnected by sewing 72. However, the reinforcing straps need not be folded if they are constructed of heavier thicker materials having greater strength, such as that available from automobile seatbelts. Furthermore, upper rear ends 69 may be connected to end door portion 52 at any suitable location on end door portion 52.

Figure 3:
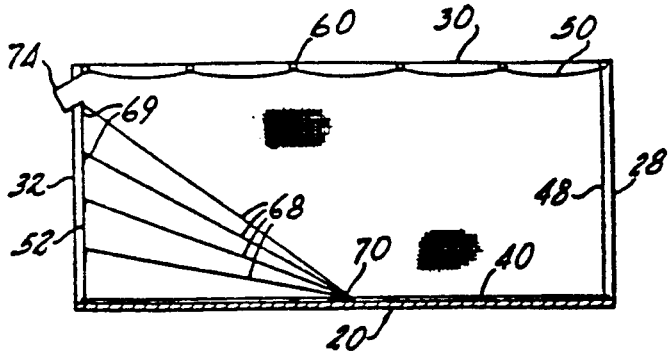
FIG. 3 is a side elevational view of the flexible insert of FIGS. 1 and 2, showing one of several alternate methods of securing a plurality of oblique reinforcing straps, each constructed to extend between lower forward ends attached to a floor portion and upper rearward ends attached to end door portion reinforcements to prevent outward bulging of the end door portion of the flexible insert when the insert is installed within the container and loaded with cargo.
Figure 4:
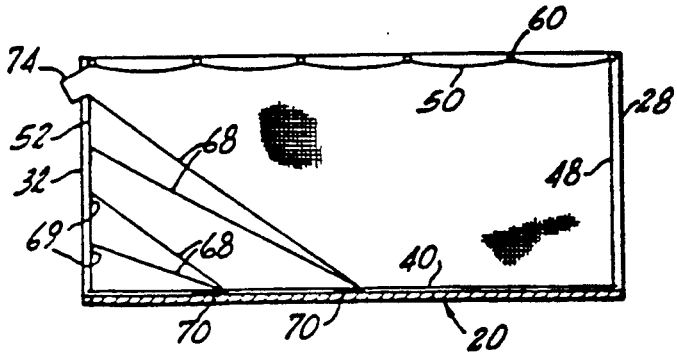
FIG. 4 is a view similar to FIG. 3 of a second embodiment of interior oblique strap arrangements.
Figure 5:
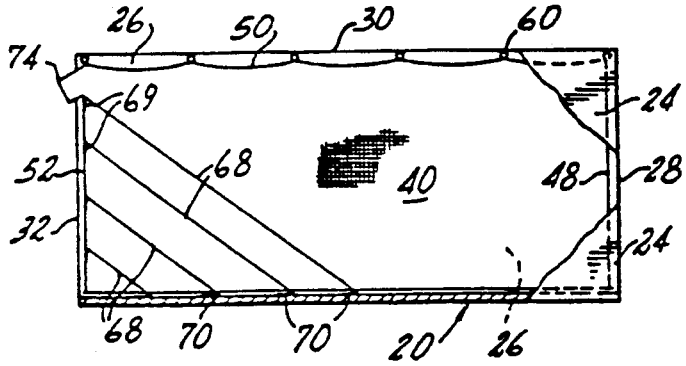
FIG. 5 is a view similar to FIGS. 3 and 4 showing a third embodiment of interior oblique strap arrangements.

Several methods of attaching the lower ends 70 of oblique reinforcing straps 68 to floor portion 42 beneath covering and reinforcing flaps 71 are depicted in FIGS. 3, 4 and 5. Each lower end 70 is reversely folded and attached to floor 22 of the container 20. The lower ends 70 are nailed at 91 or otherwise attached to a wooden floor wall 22 near flaps 71. If floor wall 22 is metal, lower ends 70 may be attached thereto by screwing. The upper ends 69 of oblique reinforcing straps 68 are preferably attached by sewing upper ends 69 at the intersections 67 of vertically extending reinforcing straps 64 and horizontally extending reinforcing straps 66 to form a checkerboard arrangement of end door sub-portions 53. An observation flap 73 may be provided on optional flap 51 or at any convenient location on end door portion 52 to provide access for the visual inspection, sampling or removal of contents. One or more loading and exhaust pipes 74 may be provided to remove exhaust air and fumes, etc. when cargo is introduced.

Figure 2:
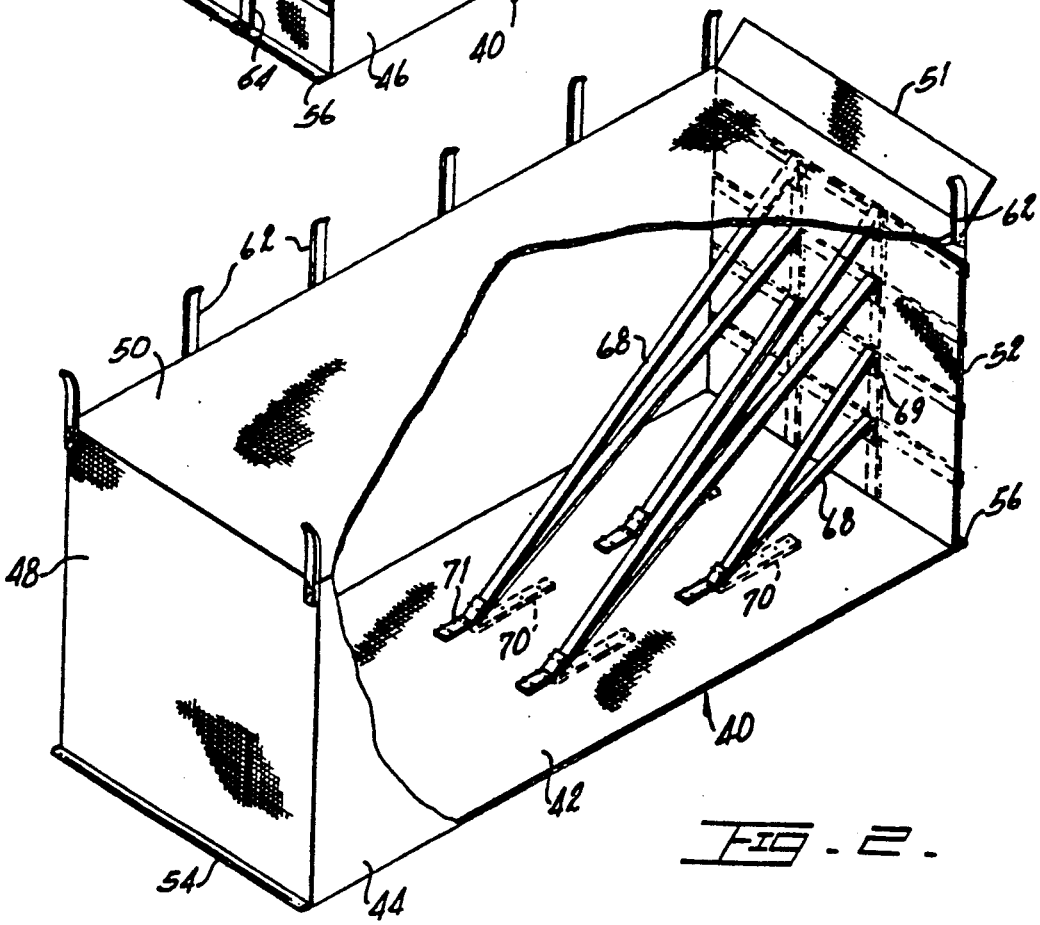
FIG. 2 is a partially cut-out isometric view from the front of a front end portion of a flexible insert or liner open to show some of the inside strap reinforcement arrangements.

The oblique reinforcing straps 68 are composed of plastic material of low stretchability, about ⅛ to ¼ inch thick and 3 to 4 inches wide, for example, and may be attached at transversely spaced locations at their lower ends along a single transversely extending area of attachment only and extend upwardly to different tiers of intersections 67 of horizontally extending reinforcing straps 66 with vertically extending reinforcing straps 64 as shown in FIGS. 1, 2 and 3. Alternately, the lower ends 70 of oblique reinforcing straps 68 may be attached to floor wall 22 along different intermediate areas at longitudinally offset locations as depicted in alternate embodiments in FIGS. 4 and 5. Random arrangements for the attachment areas of lower ends 70 to floor wall 22 may also be made. Metal chains may replace oblique reinforcing straps 68.

Figure 12A:
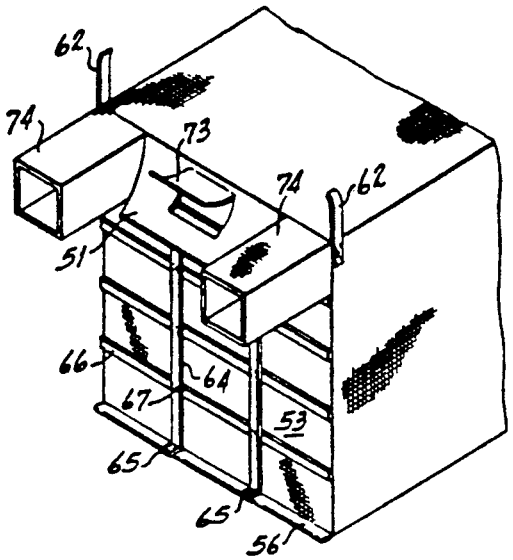
FIG. 12A is an isometric view looking at the outside of the end door portion of the insert modified by a flapped end sub-portion flanked by a pair of loading and exhaust pipes.
Figure 12B:
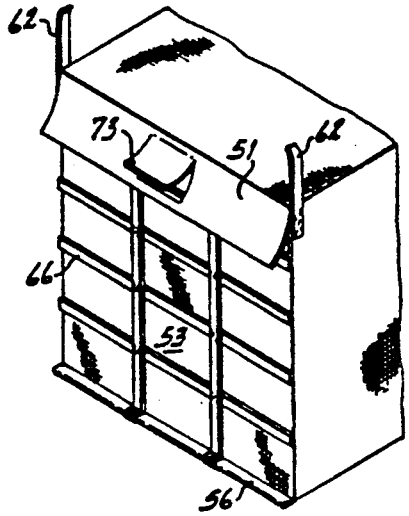
FIG. 12B is a view similar to FIG. 12A showing an alternate construction of the upper flap portion with a local flap as in FIG. 12A but omitting the loading and exhaust pipes.
Figure 12C:
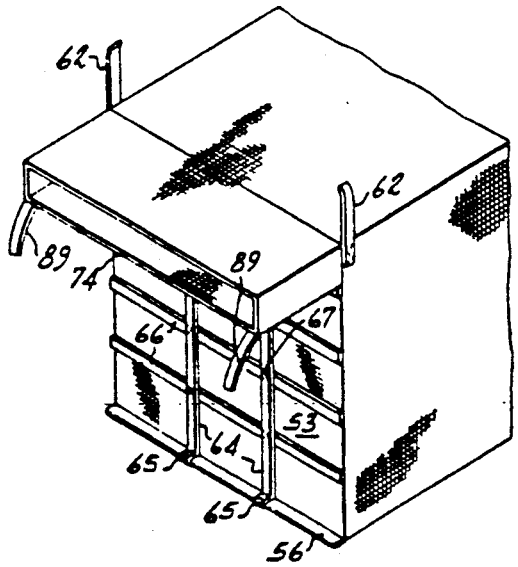
FIG. 12C is a view similar to that of FIGS. 12A and 12B showing an alternate embodiment of end door portion for the insert having a single loading and exhaust pipe extending across the entire width of an upper tier of end door sub-portions.
Figure 13:
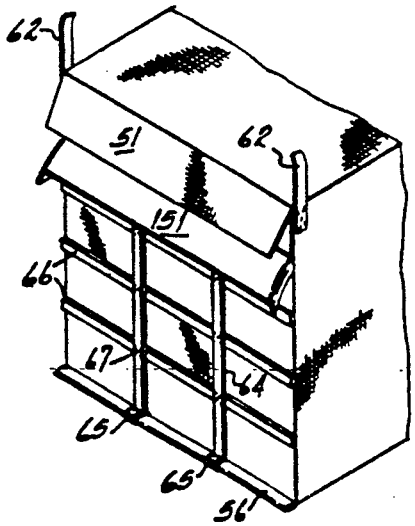
FIG. 13 is a view similar to those of FIGS. 12A, 12B and 12C showing still another embodiment of an end door portion that comprises an optional supplemental flap portion.

Optional upper flap portion 51 may be provided with an observation flap 73 as shown in FIGS. 12A and 12B. Loading and exhaust pipes 74 may extend completely across the width of the end door portion 52 as in FIG. 12C or may flank opposite sides of an optional upper flap portion 51 as depicted in FIG. 12A. An additional optional flap 151 may be provided as shown in FIG. 13 in case of large loads where additional support is needed to hold a larger cargo. A probe, not shown, may be inserted into any end door sub-portion 53 desired to sample the cargo. Supplemental straps 89 (FIG. 12C) are used to secure exhaust pipe 74 in a closed condition, preferably by sewing or tying. Supplemental straps 89 may also be used in FIG. 12A if desired, even though omitted from the drawing.

A typical technique for installing a flexible insert 40 within a container 20 is depicted in FIGS. 7A through 7D. Initially, flexible insert 40 is inserted in folded flat condition with its floor portion 42 disposed over the floor wall 22 of container 20, exposing only optional front flap portion 54 or its front end adjacent end wall 28. Optional rear flap portion 56, initially folded to expose only forward flap portion 54, is unfolded to expose an intermediate area containing lower forward ends 70 for nailing or screwing to floor wall 22. Since container doors (not shown) are open, it is possible to enter container 20 to nail optional front flap portion 54 to the front end of floor wall 22, nail forward ends 70 to one or more intermediate parts of container floor wall 22, unfold insert 40 further to the rear, and lift the innermost top straps 62 adjacent the front corner adjacent closed end wall 28 of container 20 to loop through corresponding innermost top cargo rings 60 and secure the front of optional roof portion 50 to the front of optional roof wall 30.

If it is desired to have the insert reusable, it is suggested that a buckle 63 be used to tighten the strap 62 so as to lift the optional roof portion 50 of flexible insert 40 upward toward the top cargo rings 60 at the front upper corners of the container 20.

Before the securement is made at the upper top corners, the optional front flap portion 54 or the front end of flexible insert 40 is nailed to the floor 22 adjacent closed front end wall 28. Then going from right to left, as appears in FIGS. 7B, 7C and 7D, the flexible insert 40 is lifted with additional top straps 62 from right to left being attached securely to corresponding cargo rings 60 until a portion of the length of the optional roof portion 50 and side portions 24 and 26 are suspended.

Insert 40 has been prefabricated with flaps 71 covering slots through which lower ends 70 extend to prevent loss of cargo from insert 40. As the latter is unfolded within the container 20 and smoothed, lower ends 70 folded rearwardly from floor portion slots are exposed to be nailed or screwed to floor wall 22. Lower ends 70 of oblique straps 68 are attached to floor wall 22 of container 20 after the forward part of floor portion 42 is smoothed to make it unwrinkled. Optional longitudinal reinforcements 57, if present, are also attached to floor wall 22 from front to rear. Flaps 71 are pre-sewn to floor portion 42 to close the slots through which lower ends 70 extend. Also, optional roof portion 50 and/or side wall portions 44 and 46 are suspended at spaced suspension points provided by the spaced connections of the remaining top straps 62 to corresponding spaced top cargo rings 60 along the length of the optional roof wall 30 and/or the upper edges of side walls 24 and 26.

After the flexible insert 40 becomes fully unfolded, optional rear flap portion 56 or the rear end of floor portion 42 is nailed to the rear of floor wall 22. Now, insert 40 is suspended at its optional roof portion 50 and side portions 44 and 46 by the connections between top straps 62 and top cargo rings 60 and the attachment of optional front flap portion 54, lower ends 70, and optional rear flap portion 56 and/or optional longitudinal reinforcements 57 of flexible insert 40 to floor wall 22 of container 20. Thus, the insert 40 obtains the shape depicted in FIG. 7D. Obliquely extending reinforcing straps 68 when taut increase the resistance of end door portion 52 to deform in response to outward pressure of a cargo thereagainst.

Optional upper end flap portion 51 is lifted and material to be shipped is inserted through spaces covered by optional flap portion 51 flanked by exhaust pipes 74 to load insert 40 with material to be shipped. Pipes 74 are of sufficiently large cross-section to leave room for exhausting air when insert 40 is loaded rapidly.

Figure 14:
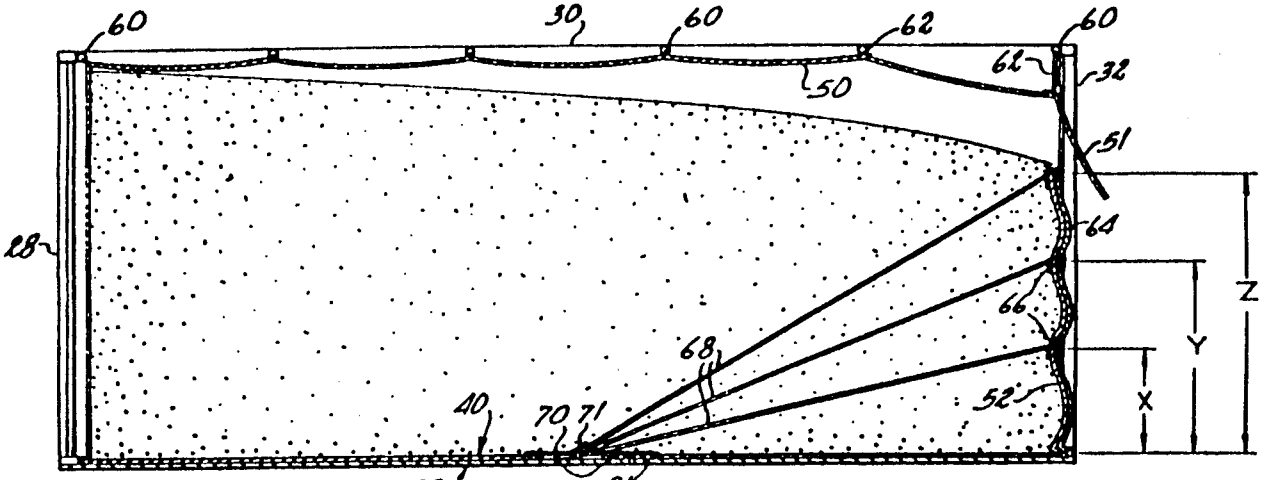
FIG. 14 is an elevational schematic view showing how the end door portions of the flexible insert are arranged for a relatively small load.

Inner closed end portion 48 is lifted by tightening top straps 62 at the inner end of the insert 40 for the container 20 to a level depicted in FIG. 14 where the heights X, Y and Z of horizontally extending reinforcing straps 66 of the end door sub-portions 53 are sufficient to enable flexible end portion 52 to maintain a predetermined normal load inserted into the flexible insert 40 forward of door wall 32 without bulging. Optional flap 51 or, if flap 51 is missing, the upper end of flexible end door portion 52 is then closed and sewn if necessary, and pipes 74 are rolled and tied up when loading is completed to insure that the load of granular material is maintained within the flexible insert 40 for container 20 during transport of the load from the loading station to the unloading station.

Figure 15:
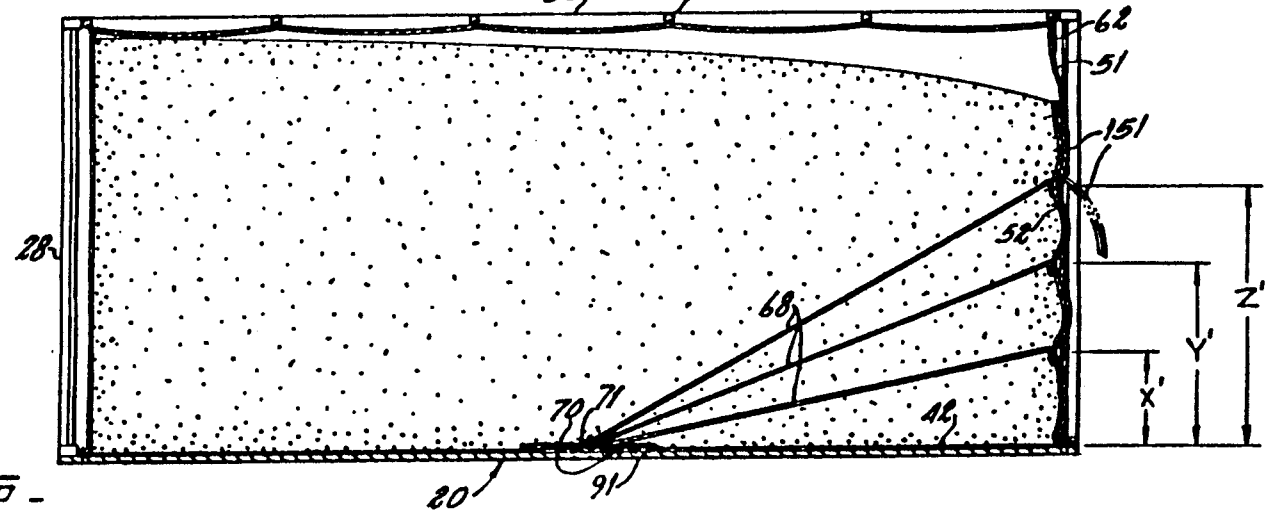
FIG. 15 is a view similar to FIG. 14 showing how the end door portion of the flexible insert is arranged with the supplemental flap portion of FIG. 13 when a larger load than that of FIG. 4 is loaded into the container.

If the load within container 20 is larger than depicted in FIG. 14, as shown in FIG. 15, then an auxiliary optional flap 151 is provided for end door portion 52 at the right end of the figure and is sewn to the side portions 44 and 46 during or prior to loading to augment the height of the lower three levels or tiers of end door portion 52 above heights equal to X', Y' and Z', respectively and enable auxiliary flap portion 151 below the flap portion 51 to withhold the load above level Z' as depicted in FIGS. 13 and 15. FIG. 15 shows auxiliary flap 151 in phantom hanging down and in full lines supplementing the height of end door portion 52.

If the load to be inserted into container 20 when flexible insert 40 is installed is smaller than the capacity of container 20, upper end flap portion 51 may be omitted and so may the auxiliary flap portion 151. Obliquely extending reinforcing straps 68 are sufficiently strong to prevent end door portion 52 from bulging outward when end door wall 32 of a loaded container 20 is open and end door portion 52 is lifted toward the upper end of container 20. Omitting upper end flap portion 51 leaves an opening above end door wall portion 52 and below optional roof wall 30 through which air may escape when insert 40 is loaded.

Optional roof wall 30 may be apertured and provided with a downwardly extending sleeve (not shown) to enable container 20 to be loaded through said roof. Under such circumstances, roof portion 50 may be partially or entirely omitted or provided with one or more apertures 49 (FIG. 21) constructed and arranged for alignment with each roof aperture (not shown). Straps 62 attach side portions 44 and 46 to corresponding cargo rings 60 along side walls 24 and 26.

Figure 16A:
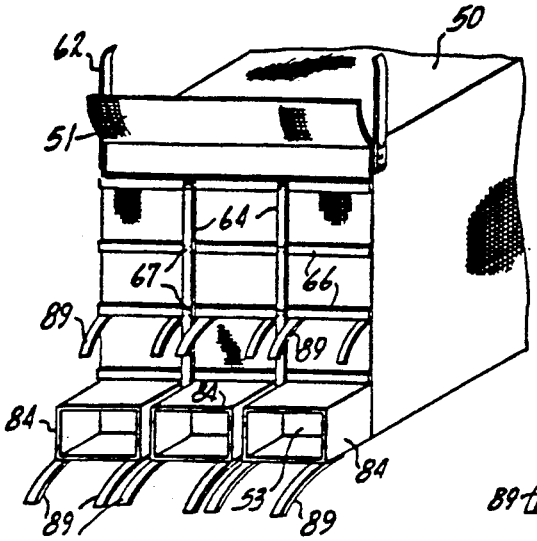
FIGS. 16A, 16B, 16C and 16D are isometric end views of the door portion of the flexible insert while unloading a cargo, FIG. 16A showing the use of three shooters, FIG. 16B showing an enlarged shooter, FIG. 16C showing an alternate construction of an unloading shooter and FIG. 16D showing an end arrangement without a shooter at the bottom, and also including an alternate structure in which a selected oblique reinforcing strap is secured at one end to a selected cargo ring.
Figure 16B:
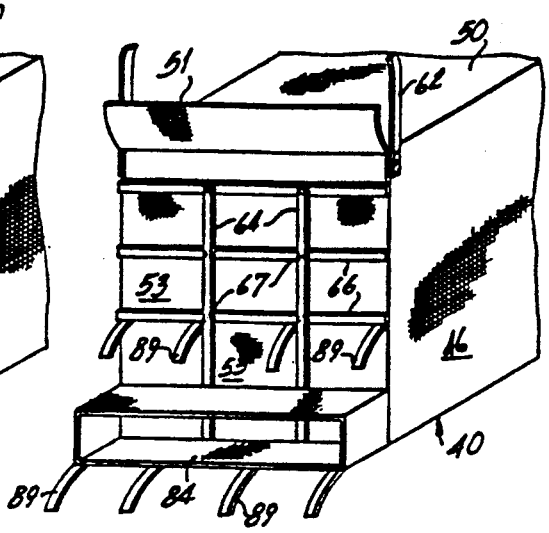
Figure 16C:
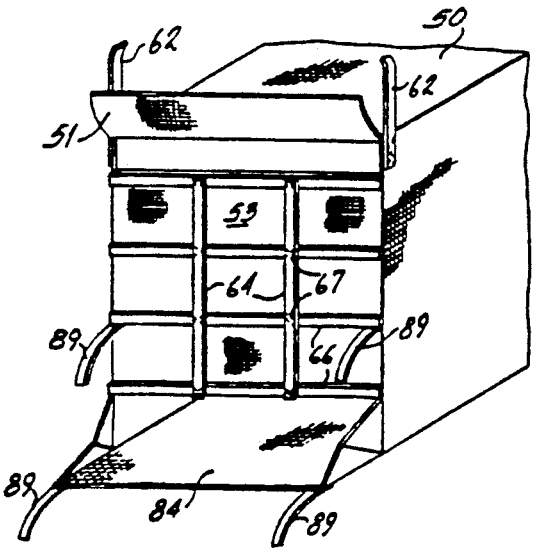

It is possible to use shooters 84 as a means for unloading the contents from within the flexible insert 40 without causing a load to be emptied at such a severe rate that it presents a danger to unloading personnel. Various alternative arrangements for unloading devices or shooters may be provided such as depicted in FIGS. 16A, 16B and 16C. Also, it is understood that shooters 84 may be shaped in cross-section to conform to the rectangular or other shape of the end door sub-portions 53. Shooters 84 may be opened according to a desired program as the flexible insert 40 is unloaded. By programming the successive positions where access openings for the sub-portions 53 are opened, dangerous accidents are avoided.

The drawings show different variations of this invention. For example, in FIGS. 3, 6 and 7D, all the oblique reinforcing straps 68 are attached at their lower, forward ends 70 along a common transverse area of attachment and extend upwardly and rearwardly to their upward and rearward ends 69 attached to the intersections 67 of different vertically extending reinforcing straps 64 and horizontally extending reinforcing straps 66 at different tiers so that oblique reinforcing straps 68 radiate upward to a taut condition in different directions from a common transverse area of attachment when flexible end door portion 52 is lifted to enable end door portion 52 to retain a cargo of liquid or pulverulent material within insert 40. In FIG. 4, as in FIGS. 1 and 2, two sets of oblique reinforcing straps 68 are provided, with the lower, forward ends 70 of some of oblique straps 68 attached to floor wall 22 along a first intermediate area of connection to extend upward and rearward to the upper intersections 67 while the remaining oblique straps 68 are attached to a second part of floor wall 22 along a second intermediate area of connection to radiate upward and rearward to lower intersections 67. In FIG. 5, the oblique straps 68 are arranged in a different set of transversely spaced oblique straps attached at their lower forward ends 70 to different transverse areas of connection along the length of floor wall 22. The forwardmost ends 70 of oblique straps 68 interconnect floor wall 22 along a forwardmost transverse area of connection with the intersections 67 of vertically extending reinforcing straps 64 and horizontally extending reinforcing straps 66 along the uppermost tier of sub-portions 53. In this latter embodiment, successive sets of oblique straps 68 have their lower, forward ends 70 attached to successive transverse areas of connection spaced rearwardly of one another and extending upwardly and rearwardly to intersections 67 located along successive tiers, each lower than the previous attached tier, to develop the arrangement shown in FIG. 5. In another alternative attachment arrangement, forward ends 70 are attached to floor wall 22 in a random arrangement of attachment areas.

Referring to FIGS. 12A , 12B, 12C and FIG. 13, various arrangements of local observation flaps 73 and exhaust pipes 74 are shown. Each of the end door sub-portions 53 may be provided with local flaps 73 as needed for inspection or with exhaust/feeder pipes 74 for loading, sampling and unloading. FIG. 12A shows an upper end flap portion 51 flanked by a pair of feeder pipes 74 to close an opening above the highest tier of sub-portions 53. In FIG. 12B, upper end flap portion 51 extends completely across the opening above the tiers of end door sub-portions 53 In FIG. 12C, an exhaust-/feeder pipe 74 extends across the entire opening above the tiers.

In FIG. 13, an auxiliary flap portion 151 is located below upper end flap portion 51 to increase the effective height of the tiers of end door sub-portions 53. Auxiliary flap portion 151 may also replace upper end flap portion 51 and may be foldedly attached to the upper end of end door portion 52 and assume the position occupied by end flap portion 51 when auxiliary flap portion 151 is unfolded and secured by attachment straps (not shown) to cargo rings 60 or additional attachment straps (not shown) fixed across the optional roof wall 30 or the upper end of door wall 32 at the rear end of container 20.

Figure 16D:
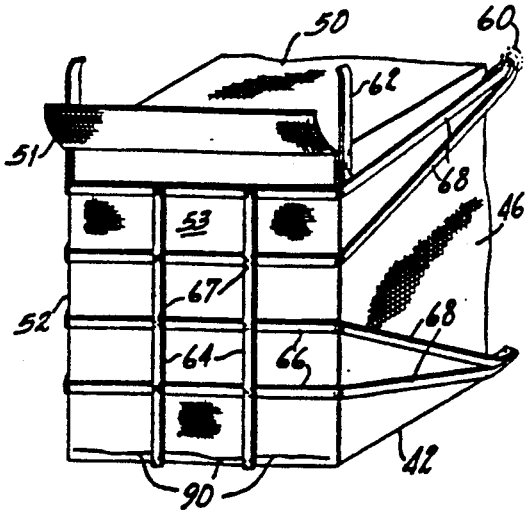

Shooters 84 may be provided for unloading wherever desired in door wall portion 52. FIG. 16A shows a series of horizontally aligned shooters 84 replacing sub-portions 53 along the lowest tier of sub-portions 53. In FIG. 16B, a shooter 84 extends the entire length of the lowest tier. The shape of the shooters 84 is rectangular in the previous figures. In FIG. 16C, shooter 84 is constructed with a floor and sidewalls, but no roof. In FIG. 16D, door wall portion 52 is not provided with a shooter and unloading may be accomplished by slitting door wall portion 52, such as shown by reference number 90. A flap portion 51 shown in FIGS. 16A–16D does not have an inner inspection flap 73, but may be so provided. In other words, the design of exit door portion 52 is flexible depending on the demands for loading, inspecting and/or unloading. Shooters 84 can be closed by rolling and tying or sewing supplemental straps 89 (see FIGS. 16A, 16B and 16C) until the time it is necessary to unload the cargo.

Oblique interior reinforcing straps 68 are shown in FIGS. 1 and 2 with lower forward ends 70 attached to floor wall 22 and upper rear ends 69 attached to reinforcing straps 64 and 66 at their intersections 67. However, oblique reinforcing straps 68 may be attached to or extend from any reinforcing strap 64 or 66 in spaced relation to intersections 67 and may extend in an oblique forward direction either downward toward floor wall 22 or upward to a convenient top cargo ring 60 attached to either side wall 24 or 26 or closed front end wall 28 or optional roof wall 30.

FIG. 16D shows an embodiment wherein an oblique reinforcing strap 68 extends forward along side portion 46 from an end of a horizontally extending reinforcing strap 66 obliquely upwardly to an upward and forward attachment to a suitable top cargo ring 60 shown in phantom. A similar connection may be made along side portion 44. FIG. 16D also shows oblique reinforcing straps 68 attached at their upper rear ends to relatively low horizontally extending reinforcing straps 66 of end door portion 52 and at lower forward ends to a container floor wall 22 on which insert floor portion 42 rests in the manner of FIG. 1.

The reinforcements provided by attaching certain oblique reinforcing straps to cargo rings supplement the reinforcement obtained from oblique reinforcing straps connected to the container floor wall. The additional oblique reinforcement straps 68 of FIG. 16D are directly attached to side wall portions 44 and 46 along either their inner or outer surfaces to further reinforce said side wall portions against outward bulging.

The optional roof wall 30 may be apertured and the insert constructed and arranged with an optional roof portion 50 open at 49 (FIG. 21) in alignment with the apertured portion of optional roof wall to permit entry of cargo into said insert via aligned apertured portions of roof wall 30 and in roof portion 50 with removal of air from the insert above its end door wall portion 52. Loading insert 40 straightens the obliquely extending reinforcing straps and reinforces exit door portion 52 against outward bulging. Final closing of end door portion 52 is accomplished by attaching end door portion straps to corresponding cargo rings attached across the rear end of the optional container roof 30 and/or the upper, rear ends of container side walls 24 and 26.

It is also possible to eliminate a closing flap portion 51 extending rearward and downward from the optional roof portion of the insert. When the cargo loaded into the insert is less than a full load, no closing flap portion extending rearward and downward from the roof portion need be present. It is also possible to support a full load of cargo within the insert by attaching an auxiliary flap portion 151 to the upper end of the reinforced end door portion 52 as a substitute for the end flap portion 5 that overlaps end door portion 52 in the first embodiment described. The resulting structure would be similar to that of FIG. 13, except that optional flap portion 51 is omitted and auxiliary flap portion 151 extends upward from the upper end of end door portion 52 to approximately the rear end of optional roof portion 50 but has straps 62 at the upper end of auxiliary flap portion 151 constructed and arranged to engage cargo rings 60 or additional straps 62 across the rear end of optional roof wall 30 to close the opening below optional roof portion 50 without any other direct connection between auxiliary flap portion 151 and roof portion 50.

FIG. 17A shows an embodiment of this invention in which insert 40 has a single flexible end door portion 52 and other wall portions are missing. In this embodiment, a transverse reinforcement 55 is fixed to the bottom of flexible end door portion 52, which also contains upwardly extending flexible straps 62 that cooperate with cargo rings 60 supported along the upper part of container 20 to suspend end door portion 52 therefrom. Criss-crossing reinforcements 64 and 66 form intersections 67 throughout the area of flexible end door portion 52 to reinforce the latter. Intersections 67 are preferred locations for attaching the rear ends of oblique reinforcing straps 68 to flexible end door portion 52, although any location in portion 52 may be chosen for attaching the rear end 69 of any oblique reinforcing strap 68. The forward ends 70 of oblique reinforcing straps 68 are secured to floor wall 22 of container 20 so that when container 20 is filled, oblique reinforcing straps 68 are taut to prevent outward bulging even in the absence of any other wall portions for flexible insert 40. Thus, straps 62 cooperate with cargo rings 60 to provide suspension means, and nails 91 extending through transverse reinforcement 55 and forward ends 70 provide attachment means securing insert 40 in fixed relation to floor wall 22 of container 20. It is understood that this embodiment is designed especially for use with cargo that can be readily removed from container 20 and that does not harm the latter by storage therewithin.

FIG. 17B shows an embodiment similar to FIG. 17 wherein the end door portion 52 of the FIG. 17A embodiment is attached to a floor wall portion 42 of an unreinforced flexible insert 40 through transverse reinforcement 55 at the rear end of floor portion 42 and through forward ends 70 of flexible obliquely extending reinforcing straps 68 at the intermediate part of floor portion 42. In this embodiment, unreinforced flexible insert 40 has no oblique reinforcement straps 68 and comprises a floor portion 42 as well as end door portion 52 and side wall portions (such as 44 and 46 of earlier embodiments) and an optional roof portion (such as 50 of earlier embodiments). End door portion 52 is interposed between unreinforced flexible insert 40 and container 20. This protects the inner surfaces of the corresponding walls of container 20 from direct contact with a cargo. In this FIG. 17B embodiment, the front part of floor portion 42 of unreinforced flexible insert 40 rests on the front part of floor wall 22 and the rear part of floor portion 42 rests on taut oblique straps 68 and the rear part of floor wall 22, when unreinforced insert 40 contains a cargo. Attachment means 91 that fix the forward ends 70 of oblique reinforcing straps and transverse reinforcement 55 to floor portion 42 also inherently attach ends 70 and transverse reinforcement 55 to floor wall 22. In retrospect, the broadest aspect of this invention relates to a flexible insert 40 comprising a flexible end door portion 52 having suspension means extending upward to cooperate with cooperative suspension means fixed to the upper part of the container, a transverse reinforcement 55 for the bottom of said flexible end door portion 52 and obliquely extending reinforcing straps 68 connecting end door portion 52 directly to container 20. The presence of additional wall portions for optional unreinforced flexible insert 40 protects container 20 from damage due to direct exposure to the cargo.

Figure 19:
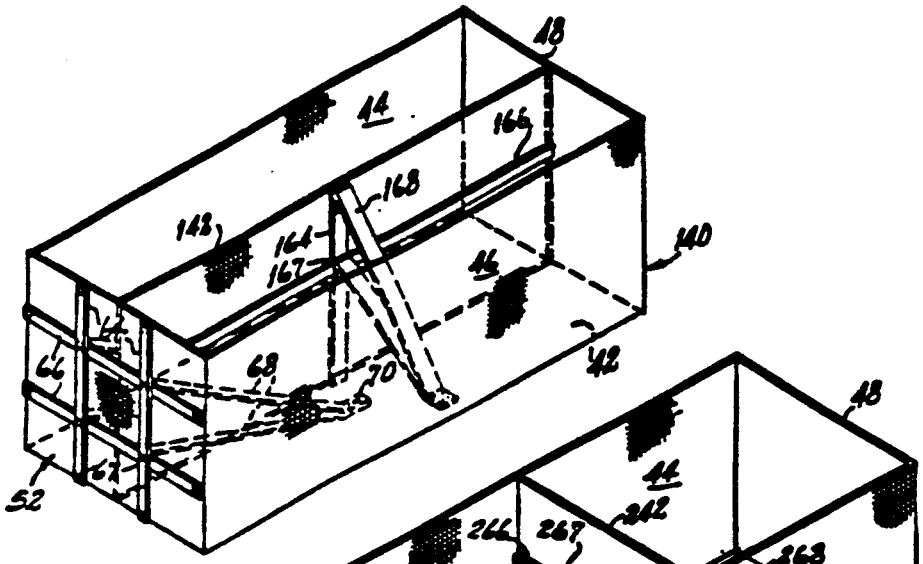
FIG. 19 is an isometric view, similar to that of FIG. 1, of an insert having a flexible longitudinal wall dividing the insert into two longitudinally extending insert compartments.
Figure 20:
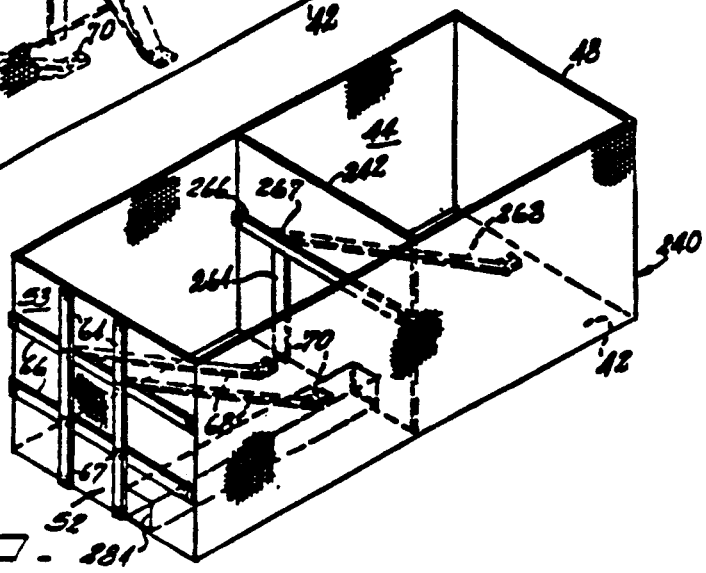
FIG. 20 is an isometric view similar to that of FIG. 18, of an insert having a flexible transverse wall dividing the insert into front and rear compartments.

In other embodiments of this invention illustrated in FIGS. 19 and 20, the flexible insert is divided into compartments to transmit loads of the same or different material simultaneously. FIG. 19 shows a flexible insert 140 having a floor portion 42, side wall portions 44 and 46, front end portion 48 and an end wall portion 52 corresponding to portions identically numbered in FIGS. 1 and 2 with a roof portion omitted to show an optional interior, longitudinally extending flexible wall portion 142 having crisscrossing reinforcements 164 and 166 forming intersections 167 similar to reinforcements 64 and 66 and intersections 67 on end door portion 52. Only one of many reinforcements 164 and 166 and only one of many intersections 167 are shown in FIG. 19 to simplify illustration. Oblique interior transverse reinforcements 168 similar in structure to oblique internal reinforcements 68 of the earlier embodiment are unfolded to be taut to support longitudinally extending wall portion 142 from bulging transversely outward away from the rest of the compartment containing oblique reinforcements 168. To accomplish this end, oblique reinforcements 168 are connected at a first end to floor portion 42 and at a second end to interior wall portion 142. A first longitudinal compartment containing oblique reinforcements 168 is loaded. Then, With interior wall portion 142 supported against bulging by taut reinforcements 168, the second longitudinal compartment without oblique reinforcements 168 is loaded with another cargo. At its destination, the second compartment is unloaded first while the first compartment is supported in unbulging condition.

The FIG. 20 embodiment is similar to the FIG. 19 embodiment except that the insert 240 of FIG. 20 has a transversely extending flexible wall portion 242 that separates insert 240 into front and rear compartments. Transverse wall portion 242 has crisscrossing reinforcements 264 and 266 forming intersections 267 similar to reinforcements 64 or 164 and 66 or 166 and intersections 67 or 167. Oblique reinforcing straps 268 similar to oblique straps 68 interconnect transverse wall portion 242 to floor portion 42 in the front compartment. A shooter 284 extends from the front compartment through transverse wall portion 242 and the rear compartment to provide an unloading passage through end wall portion 52. Since the front compartment contains oblique reinforcements 268, it is more convenient to first load the front compartment with one cargo, thereby reinforcing transverse wall portion 242 against forward bulging before loading the rear compartment.

It is understood that oblique interior reinforcements 68 connecting end door portions 52 to floor portions 42 are present in the FIG. 19 and FIG. 20 embodiments even though many oblique interior reinforcements 68 are omitted from the drawings and that internal dividing wall portions 142 or 242 have many crisscrossing reinforcements 164 and 166 or 264 and 266 making many intersections 167 and 267 even though many of these structural elements have been omitted from FIGS. 19 and 20 to simplify the drawings. It is also understood that the crisscrossing reinforcements 164 and 166 or 264 and 266 may extend in oblique directions as well as horizontally and vertically as depicted without departing from the gist of this invention.

Conforming to requirements of the patent statutes, the present invention has been described in terms of a preferred embodiment and various modifications thereof. It is understood, however, that further modifications may be made in the light of the description that has been made and that the scope of the protection provided is defined by the claimed subject matter that follows.

What is claimed is:

1. A flexible insert for installation within a container of generally rectangular configuration having a generally planar floor wall, a pair of generally planar side walls, a generally planar front end wall and a generally planar closeable rear door wall extending upwardly from said floor wall, said insert comprising insert portions constructed and arranged to fit within said container and to be unfolded into a floor portion facing said floor wall and constructed and arranged to be supported on said floor wall, a pair of side wall portions facing said side walls and extending within said side walls, a front end portion facing said front end wall and extending within said front end wall and a rear door portion facing said rear door wall and extending upwardly from said floor portion within said door wall, said insert being constructed and arranged to receive means to secure at least one of said insert portions to a facing container wall to prevent relative movement therebetween, insert suspension means comprising suspension means elements carried by said insert and cooperating suspension means elements carried by said container, characterized by a plurality of obliquely extending interior reinforcing straps, each having a first end secured to said end door portion and a second end secured to at least one of the other portions of said insert in position for securement to a wall of said container that faces said one of said other portions of said insert, said obliquely extending straps being constructed and arranged to be taut to support said end door portion against bulging outward when said insert is loaded with a cargo of granular material or a liquid stored in said insert.

2. A flexible insert as in claim 1, wherein said other of said portions is said floor portion of said insert.

3. A flexible insert as in claim 2, wherein said floor portion contains a front flap portion and a rear flap portion constructed and arranged to reinforce said floor portion to receive said securing means to attach said floor portion to said floor wall.

4. A flexible insert as in claim 2, wherein said insert suspension means comprises a plurality of suspension straps carried by the upper part of said insert and a plurality of cooperating suspension rings or suspension straps carried by said container in position to cooperate with said suspension straps.

5. A flexible insert as in claim 2, wherein said container further comprises a roof wall and said insert comprises a roof portion facing said roof wall and said insert suspension means further comprises suspension means elements carried by said roof wall and cooperating suspension means elements carried by said roof portion constructed and arranged to suspend said roof portion below said roof wall.

6. A flexible insert as in claim 5, wherein said end door portion comprises an upper flexible flap portion suspended from said roof portion and constructed and arranged to be lifted to provide an access opening for inserting cargo into and exhausting air from said insert and to be unfolded into overlapping relation with said end door portion.

7. A flexible insert as in claim 6, further including cooperating suspension means members attached respectively to said upper flexible flap portion and to said end door portion to secure said upper flexible flap to said end door portion and to close said access opening.

8. A flexible insert as in claim 5, wherein said end door portion has a plurality of spaced reinforcing straps and each of said obliquely extending interior reinforcing straps is secured at its first end to one of said reinforcing straps.

9. A flexible insert as in claim 8, wherein said spaced intersecting reinforcing straps crisscross to form intersections and said first ends of said obliquely extending interior reinforcing straps are secured to said intersecting reinforcing straps at different of said intersections.

10. A flexible insert as in claim 8, wherein said spaced intersecting reinforcing straps comprise a plurality of vertically spaced, horizontally extending reinforcing straps and a plurality of horizontally spaced, vertically extending reinforcing straps.

11. A flexible insert as in claim 10, wherein said horizontally and vertically spaced reinforcement straps crisscross to form intersections and said first ends of said obliquely extending interior reinforcing straps are secured to said intersections.

12. A flexible insert as in claim 10, wherein said horizontally extending reinforcing straps and said vertically extending reinforcing straps crisscross each other to subdivide said end door portion into a plurality of vertically aligned, horizontally extending tiers of end door sub-portions and at least one of said sub-portions is provided with a closeable flap.

13. A flexible insert as in claim 12, wherein at least one of said sub-portions is provided with an exhaust pipe.

14. A flexible insert as in claim 12, wherein at least one of said subportions is provided with a shooter.

15. A flexible insert as in claim 5, wherein said roof wall contains an aperture and said roof portion contains an aperture constructed and arranged for alignment with said roof wall aperture when said insert is installed within said container to permit entry of a cargo into said insert through said aligned apertures.

16. A flexible insert as in claim 2, wherein said floor portion contains a longitudinally extending reinforcement constructed and arranged to reinforce said floor portion to receive said securing means to attach said floor portion to said floor wall.

17. A flexible insert as in claim 2, further including a flexible interior divider wall portion separating said insert into first and second compartments, further characterized by a plurality of additional obliquely extending interior reinforcing straps within one of said compartments, each of said additional straps having a first end secured to said dividing wall portion and a second end secured to said floor portion in position for securement to said floor wall, said additional straps being constructed and arranged to be taut to support said interior wall portion against bulging outward into the other of said compartments when said one compartments is loaded with a cargo of granular material or a liquid.

18. A flexible insert as in claim 17, wherein said flexible interior dividing wall portion interconnects said front end portion with said end door portion to form a pair of side by side longitudinal compartments for said insert.

19. A flexible insert as in claim 17, wherein said flexible interior dividing wall portion interconnects said side wall portions to form front and rear compartments for said insert.

20. A flexible insert as in claim 19, further including a shooter extending from said front compartment through said rear compartment and said end door portion.

21. A method of installing a prefabricated flexible insert within a generally rectangular shaped container without requiring an installer to enter said insert during said installation, said container having a floor wall, a pair of side walls, a front end wall and a rear door wall, said flexible insert being unfoldable from a flat configuration into a generally rectangular shape having a floor portion conforming generally to said floor wall, a pair of side wall portions conforming generally to said side walls, a front end portion conforming generally to said front end wall and an end door portion conforming generally to said rear door wall, said side wall portions and front end portion and said end door portion extending upward from said floor portion when said insert is unfolded, said insert having a plurality of obliquely extending interior reinforcing straps constructed and arranged to interconnect said end door portion to said floor portion and to be taut when said insert is unfolded, said method comprising inserting said insert in its flat configuration within said container with its floor portion resting on said floor wall within said container so that a front end of said insert is adjacent said front end wall, attaching said front end of said insert to a front end of said container, lifting said front end of said insert from said floor portion, suspending said front end of said insert from a front upper end of said container, unfolding said insert from front to rear until a rear end of said floor portion rests on the rear end of said floor wall while suspending increments of said side wall portions to the upper end of said container along said side walls, attaching one end of said obliquely extending reinforcing straps to an intermediate part of said floor wall, attaching a rear end of said floor portion to a rear end of said floor wall and unfolding said end door portion upwardly from the rear end of said floor portion to straighten said obliquely extending interior reinforcing straps to reinforce said end door portion against outward bulging when said insert is loaded with cargo.

22. A method as in claim 21, wherein said container has a roof wall and said insert has a roof portion conforming generally to said roof wall, wherein said insert is suspended from said container by suspending increments of said roof portion to increments of said container from the front end to the rear end of said container.

23. A method as in claim 22, wherein said roof wall has a plurality of suspension elements fixed thereto and said roof portion has a plurality of suspension elements extending therefrom and said roof portion is suspended from said roof wall by attaching corresponding suspension elements extending from said roof portion to corresponding suspension elements fixed to said roof wall.

24. A method as in claim 22, wherein said end door portion extends upward from the rear end of said floor portion to an upper auxiliary flap portion, further including folding said auxiliary flap portion downward to provide an air escape passage when said insert is loaded with cargo and unfolding said auxiliary flap upward and suspending an upper end of said upwardly unfolded auxiliary flap to the rear end of said roof portion after said cargo is loaded.

25. A method as in claim 22, wherein said roof portion has a flap portion attached to the rear end of said roof portion, further including lifting said flap portion away from said end door portion to provide an air escape passage when said insert is loaded with cargo and lowering said flap portion to overlap an upper portion of said end door portion after said cargo is loaded.

26. A method as in claim 22, wherein said roof wall and said roof portion are provided with apertures that are aligned when said insert is unfolded, further including applying a load of cargo into said insert through said aligned apertures.

27. A method as in claim 21, wherein said floor portion is reinforced at its front end and at its rear end and said floor portion is fixed to said floor wall by attaching said reinforced ends to corresponding ends of said floor wall by applying attachment means through said reinforced ends.

28. A method as in claim 21, wherein said end door portion is reinforced with crisscrossing straps and said obliquely extending reinforcing straps extend from said floor portion to at least some of said reinforcing straps in folded relation when said insert is folded, further including causing said obliquely extending reinforcing straps to straighten and become taut to reinforce said end door portion through said crisscrossing straps by unfolding said rear end door portion upwardly from said rear end of said floor portion.

29. A method as in claim 28, wherein said crisscrossing straps form intersections and said obliquely extending reinforcing straps extend from said floor portion to at least some of said intersections in folded relation when said insert is folded, further including causing said obliquely extending reinforcing straps to straighten and become taut to reinforce an end door portion through said intersections by unfolding said rear end door portion upwardly from said rear end of said floor portion.

30. A method as in claim 21, wherein said insert is provided with a flexible interior wall portion separating said insert into compartments, one of said compartments having additional obliquely extending reinforcing straps constructed and arranged to connect said flexible interior wall portion to said floor portion and to be taut to hold said interior wall portion from outward bulging when said one compartment is loaded with cargo, further including loading said one compartment with cargo until said additional obliquely extending reinforcing straps are taut, then loading the other of said compartments while said one compartment remains loaded.

31. A method as in claim 30, further including unloading said other compartment while said one compartment remains loaded, then unloading said one compartment after said other compartment is unloaded.

32. A method as in claim 30, wherein said one compartment is loaded with one type of cargo and said other compartment is loaded with a different type of cargo.

33. A flexible insert for a rigid container having a floor wall, a front end wall, a pair of side walls and a rear door wall extending upward from said floor wall, said flexible insert having a flexible end door portion that tends to bulge outward when said rear door wall is opened while said container is loaded with a cargo, characterized by means attached to said end door portion to resist outward bulging comprising suspension members extending from the upper part of said end door portion and constructed and arranged to cooperate with cooperating suspension members carried by an upper part of said container, a bottom part of said end door portion constructed and arranged for connection to a rear part of said container and obliquely extending interior reinforcing straps attached at a first end thereof to said end door portion and having a second end constructed and arranged for attachment to a wall of said rigid container other than said rear door wall in such a manner that said interior reinforcing straps extend to be taut to support said flexible end door portion against outward bulging when said end door portion is so suspended and attached.

34. A flexible insert as in claim 33, wherein said second end is constructed and arranged for attachment to an intermediate part of said floor wall.

35. A flexible insert as in claim 34, wherein said flexible insert further comprises a flexible floor portion constructed and arranged for placement between said reinforcement means and said second ends of said obliquely extending reinforcement straps on one hand and said floor wall on the other hand to protect said floor wall from damage caused by direct contact with cargo stored in said container.

36. A flexible insert as in claim 35, wherein said flexible insert further includes a flexible front end portion and spaced flexible side wall portions extending upward from said floor portion in position to shield said front end wall and said side walls of said container from direct contact with said cargo.

37. A flexible insert as in claim 34, further including spaced, reinforcing straps fixed to said end door portion to reinforce the latter, the first ends of said interior obliquely extending reinforcing straps being attached to at least one of said reinforcing straps.

38. A flexible insert as in claim 37, wherein said reinforcing straps form intersections, said intersections being fixed to the first ends of corresponding of said interior obliquely extending reinforcing straps.

39. A flexible insert as in claim 34, further including an unreinforced flexible insert free of any internal oblique reinforcing strap and comprising a floor portion, a pair of sidewall portions, a front wall portion and a rear door portion extending upward from said floor portion, said flexible end door portion being interposed between said unreinforced flexible insert and said rigid container.

40. A flexible insert as in claim 39, wherein said rigid container has a roof wall and said unreinforced flexible insert has a roof portion.

41. A flexible insert as in claim 34, further including an unreinforced flexible insert having a floor portion resting in part on said floor wall and in part on said obliquely extending interior reinforcing straps when the latter extend to be taut.

42. A flexible insert as in claim 41, wherein said unreinforced flexible insert has a front end portion and side wall portions extending upward from said floor portion to protect said walls of said container from direct contact with said cargo.

43. A flexible insert as in claim 41, wherein said end door portion is attached to a rear part of a flexible floor portion of a flexible insert having a flexible front end portion and flexible side wall portions to form a flexible insert reinforced by said obliquely extending interior reinforcing straps that support said unreinforced flexible insert within said container.

44. A flexible insert as in claim 33, further including an unreinforced flexible insert free of any internal or oblique reinforcing strap and comprising a floor portion, a pair of side wall portions, a front wall portion and a rear door portion extending upward from said floor portion, said flexible end door portion being interposed between said unreinforced flexible insert and said rigid container.

45. A flexible insert as in claim 44, wherein said rigid container has a roof wall and said unreinforced flexible insert has a roof portion.

46. A flexible insert for a rigid container having a floor wall, a front end wall, a pair of side walls and a rear door wall extending upward from said floor wall, said flexible insert having an end door portion that tends to bulge outward when said rear door wall is opened while said container is loaded with a cargo, a floor portion extending forward of said end door portion, side wall portions and a front end portion extending upward from said floor portion, obliquely extending internal reinforcing strap means connected at a first end to said end door portion and at a second end to said floor portion in such a manner that said interior, obliquely extending, reinforcing strap means extends to be taut to reinforce said flexible end door portion against outward bulging and an interior flexible insert free of obliquely extending reinforcing strap means having a floor portion constructed and arranged to rest in part on said floor portion of said reinforced insert and in part on said interior, obliquely extending, reinforcing strap means.

47. A flexible insert as in claim 46, wherein said interior flexible insert has a front end portion and a pair of side wall portions extending upward from said floor portion.

* * * * *